US006381803B1

(12) United States Patent
Berfield et al.

(10) Patent No.: US 6,381,803 B1
(45) Date of Patent: May 7, 2002

(54) VACUUM CLEANER

(75) Inventors: Robert C. Berfield, Jersey Shore; Ronald Griffin, Williamsport; Mark E. Baer, Trout Run, all of PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/543,684

(22) Filed: Apr. 5, 2000

Related U.S. Application Data

(60) Provisional application No. 60/128,027, filed on Apr. 6, 1999.

(51) Int. Cl.[7] ..... A47L 5/14

(52) U.S. Cl. ..... 15/330; 15/339; 15/412; 15/422.2

(58) Field of Search ..... 15/328, 330, 339, 15/422.2, 412

(56) References Cited

U.S. PATENT DOCUMENTS

| | | | | | |
|---|---|---|---|---|---|
| 2,049,603 | A | | 8/1936 | Dietenberger | |
| 3,240,000 | A | * | 3/1966 | Hayes et al. | 15/422.2 X |
| 3,848,290 | A | * | 11/1974 | Bates | 15/422.2 X |
| 4,225,999 | A | | 10/1980 | Martinec et al. | |
| 4,231,133 | A | | 11/1980 | Probost | |
| 4,398,316 | A | * | 8/1983 | Scott et al. | 15/339 X |
| 4,514,874 | A | * | 5/1985 | Kurz | 15/339 X |
| 4,580,309 | A | * | 4/1986 | Ogden | 15/422.2 |
| 4,694,528 | A | | 9/1987 | Comer et al. | |
| 4,723,337 | A | | 2/1988 | Ellison et al. | |
| 5,243,733 | A | | 9/1993 | Steiner et al. | |
| 5,255,409 | A | * | 10/1993 | Fujiwara et al. | 15/412 X |
| 5,400,464 | A | | 3/1995 | Steiner | |
| 5,555,595 | A | * | 9/1996 | Ligman | 15/339 X |
| 5,664,282 | A | * | 9/1997 | Castwall et al. | 15/412 X |

FOREIGN PATENT DOCUMENTS

| | | |
|---|---|---|
| DE | 948 636 | 9/1956 |

* cited by examiner

*Primary Examiner*—Chris K. Moore
(74) *Attorney, Agent, or Firm*—Marshall, Gerstein & Borun

(57) ABSTRACT

A vacuum cleaner capable of drawing different current levels in vacuum and blower modes is disclosed. The vacuum cleaner comprises at least one electric motor and an impeller disposed in an impeller housing, the impeller driven by the at least one electric motor. A receptacle has an inlet and an orifice in fluid communication with the impeller housing, wherein the impeller creates a low pressure area in the receptacle thereby drawing air into the inlet. An outlet is in air flow communication with the impeller housing, wherein air from the impeller is expelled through the outlet. A switch is associated with the outlet, wherein the switch has a first position in which a first current may be drawn by the at least one motor and a second position in which a second current, less than the first current, may be drawn by the at least one motor. A device is removably attached to the outlet for directing air.

12 Claims, 6 Drawing Sheets

VACUUM CLEANER

CROSS REFERENCE TO RELATED APPLICATION

This application claims the benefit under 35 U.S.C. § 119(e) of U.S. provisional patent application Ser. No. 60/128,027 filed Apr. 6, 1999, the disclosure of which is incorporated herein by reference.

FIELD OF THE INVENTION

The present invention relates to vacuum cleaners, and more particularly to the control of current drawn by the vacuum cleaner when it is operated as a vacuum or as a blower, and to the control of air flow within the vacuum cleaner.

BACKGROUND OF THE INVENTION

Many vacuum cleaners have the capability of use, not only as a vacuum to draw debris into a tank or receptacle, but also as a blower. Vacuum cleaners that can be used as a blower generally have a blower port onto which a flexible or rigid hose is attached. The hose is then directed at debris to move unwanted material.

Underwriter's Laboratories® creates certain standards for current (which is readily transferrable into power) for vacuum cleaners and blowers. The maximum permissible current that can be drawn is different with respect to a device used as a vacuum and as compared to a device used as a blower. When used in a vacuum mode, a maximum of 12 amps of current may be drawn at mean watts. Mean watts is defined as electric power drawn by the vacuum when the inlet to the vacuum cleaner is open, plus power drawn when the inlet to the vacuum cleaner is closed divided by two. When used as a blower, the maximum current that may be drawn is 12 amps when the blower is in the open mode. In general, in order to comply with the standards, a larger motor, which draws more current and power, can be used in the vacuum mode than can be used in a blower mode. It is also desirable to use a larger motor in a vacuum mode because a larger motor will be able to draw more air, measured in cubic feet per minute (CFM), and create a higher lift or pressure, which increases the performance of the vacuum cleaner.

It may also be desirable to use more than one air impeller in a vacuum cleaner. Two impellers can be driven off a single motor or two or more motors can be used, each having its own impeller or impellers. Under such circumstances, there may be a need to change the air flow through the various impellers to optimize performance under different conditions.

SUMMARY OF THE INVENTION

In accordance with certain aspects of the present invention, a vacuum cleaner is provided comprising at least one electric motor and an impeller disposed in an impeller housing, the impeller driven by the at least one electric motor. A receptacle is provided having an inlet and an orifice in fluid communication with the impeller housing, wherein the impeller creates a low pressure area in the receptacle thereby drawing air into the inlet. An outlet is in air flow communication with the impeller housing, wherein air from the impeller is expelled through the outlet. A switch, associated with the outlet, is provided, wherein the switch has a first position in which a first current may be drawn by the at least one motor and a second position in which a second current, less than the first current, may be drawn by the at least one motor. A device which may be removably attached to the outlet is provided, wherein the device directs air.

In accordance with additional aspects of the present invention, a vacuum is provided comprising a first electric motor, driving a first impeller, and a second motor driving a second impeller. A receptacle is provided having an inlet and an orifice establishing air flow communication between the receptacle and the first and second impellers. An outlet is in air flow communication with the first impeller and the second impeller. A valve is provided, wherein the valve is capable of converting air flow from series to parallel between the first impeller and second impeller.

Other features and advantages are inherent in the disclosed apparatus or will become apparent to those of ordinary skill in the art from the following detailed description and its accompanying drawings.

DETAILED DESCRIPTION OF THE PREFERRED EMBODIMENTS

Figure 1:
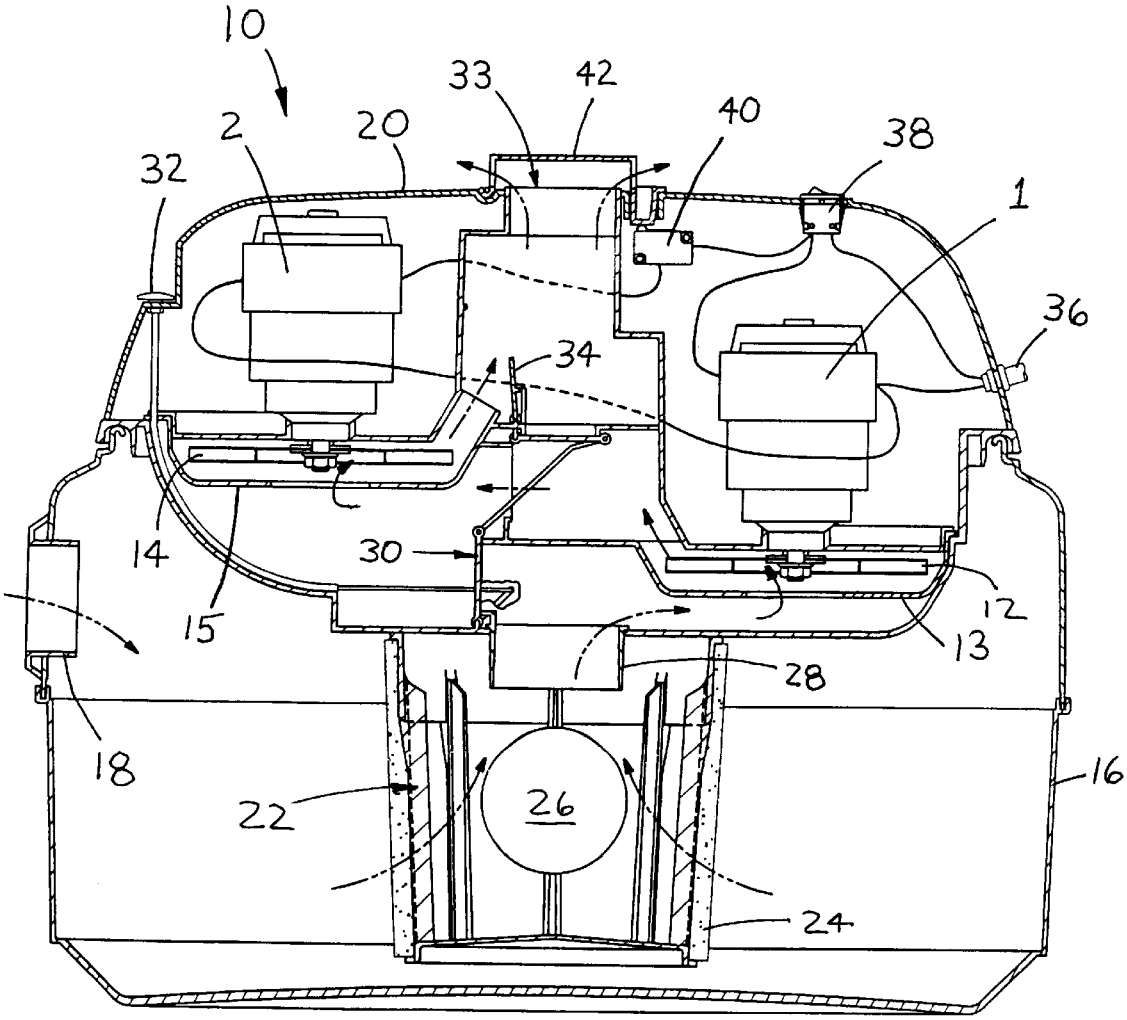
FIG. 1 is a cross-sectional view of a first embodiment of a vacuum cleaner of the present invention operating with series air flow as a vacuum.

Referring initially to FIG. 1, a vacuum cleaner 10 includes a motor 1 and a motor 2. Motor 1 drives a first air impeller 12 disposed inside a first impeller housing 13, and motor 2 drives an air impeller 14 disposed inside a second impeller housing 15. The vacuum cleaner has a tank 16 which has an inlet 18 onto which a vacuum hose (not depicted) may be connected. The motors are housed within a housing assembly 20 which is sealed to the top of the tank 16. The assembly includes a lid cage 22 having a filter 24 and a ball 26, which seats in a cup 28 to prevent water from entering into the housing 20.

The vacuum cleaner includes a valve indicated generally at 30, which is controlled by an actuator 32. In the configuration shown in FIG. 1, the valve is in a position for series operation such that air flowing from the impeller 12 next passes through the impeller 14 before exiting the vacuum cleaner through an outlet 33. Series operation is generally desirable for creating maximum lift from the vacuum cleaner, which may be helpful in picking up embedded particles such as dirt particles in floor carpeting, or heavier items such as liquid. Associated with the valve 30 is a flapper 34, which is shown in its open position in FIG. 1.

Electric power comes into the vacuum cleaner through an electrical cord 36. A switch 38 may be actuated by a user to turn the vacuum cleaner on and off. A second switch 40 is associated with the outlet 33. A cover 42 on the outlet 33 causes the switch 40 to be in a first condition or position. In the first condition of switch 40, power flows to both motor 1 and motor 2.

Figure 2:
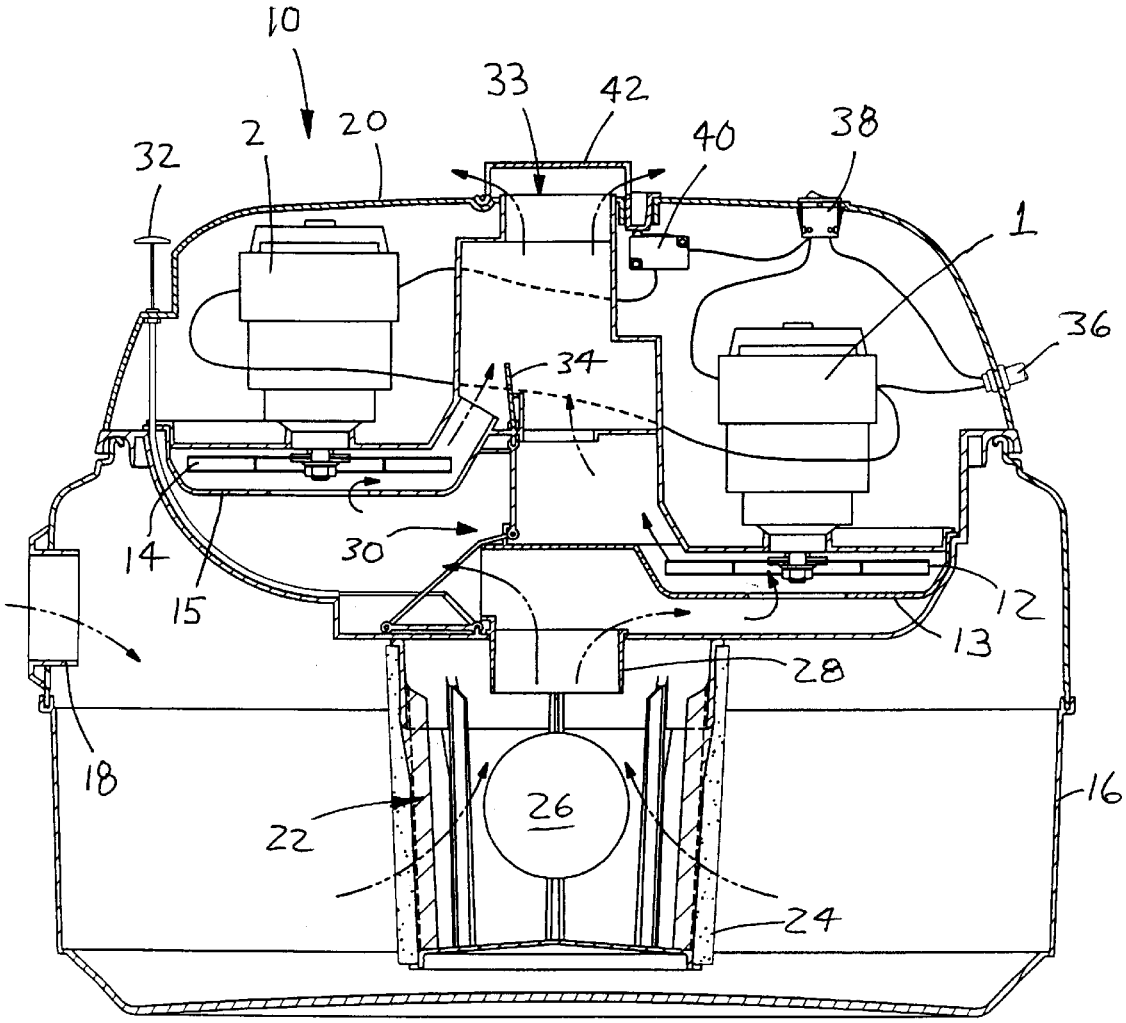
FIG. 2 is a cross-sectional view of the vacuum cleaner of FIG. 1 operating as a vacuum cleaner with parallel air flow.

FIG. 2 is identical to FIG. 1 except that the actuator 32 is in a second position such that the valve 30 allows for parallel air flow. Air passing through the cup 28 may go directly to the first impeller 12 or the second impeller 14. Air from the impeller 12 passes directly out of the outlet 33 as does air coming from the impeller 14. In the condition shown in FIG. 2, the parallel air flow allows for additional CFM of air flow. A parallel condition with increased air flow may be desirable for vacuuming with large nozzles, such as would be used to collect woodshop shavings or sawdust.

Figure 3:
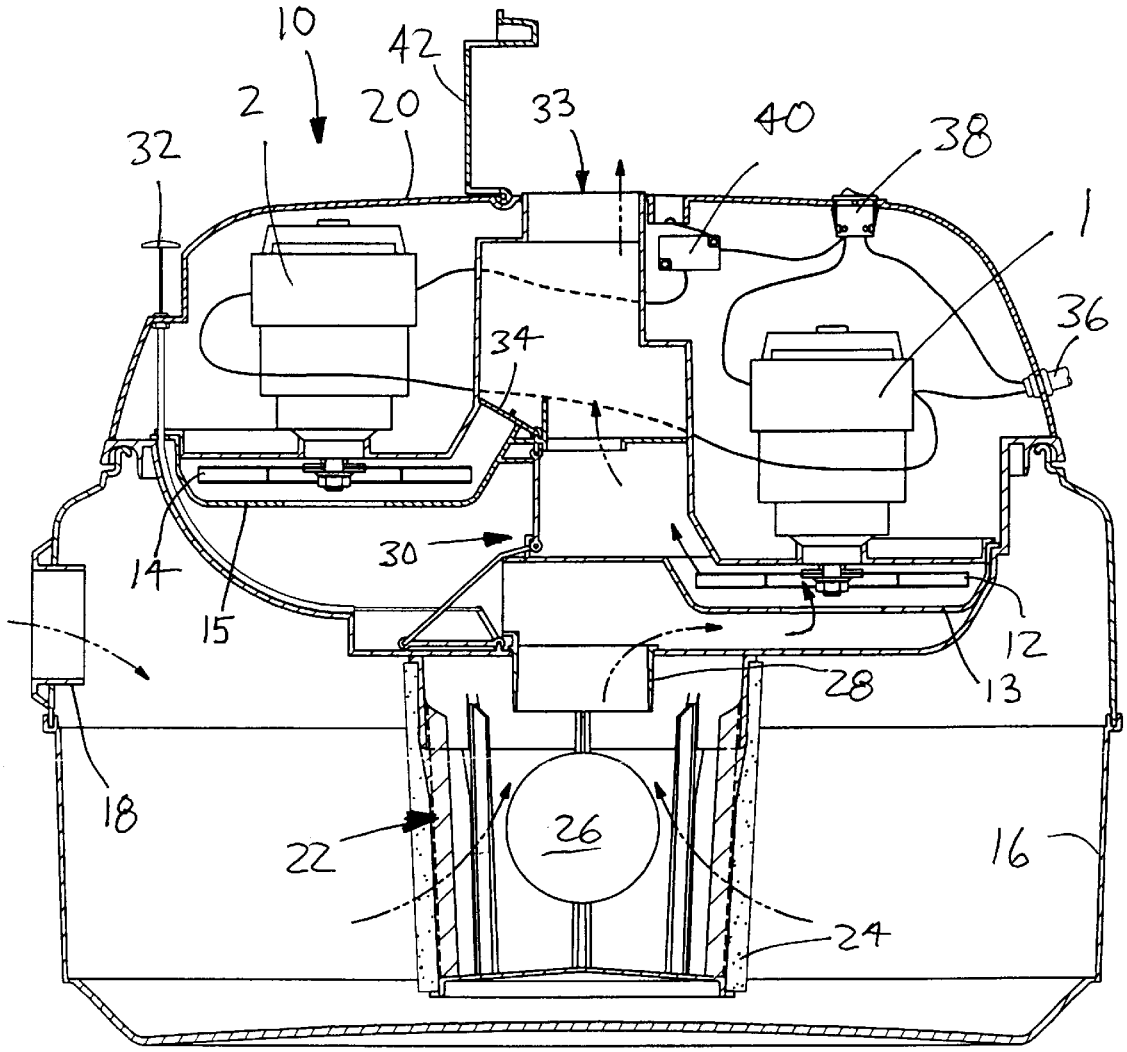
FIG. 3 is a cross-sectional view of the vacuum cleaner of FIG. 1 operating as a blower with single/parallel air flow.

FIG. 3 depicts operation of the vacuum cleaner 10 with the cover 42 open. In such a condition, a hose (which may be flexible or rigid) may be attached to the outlet 33 so that the vacuum cleaner 10 may be used as a blower. By opening the cover 42, the switch 40 has been put into a second condition or position. The second condition of the switch 40 prevents any power from flowing to the motor 2. Thus, no air will flow from impeller 14. Under such circumstances, it may be desirable to close the flapper 34, which can be accomplished simply through a spring bias, gravity, air pressure from the impeller 12, or manual activation. If motor 1 and motor 2 are properly designed, they may be able to achieve the maximum current draw of 12 amps of mean watts when operating together in a vacuum mode, while still operating at a maximum of 12 amps in the blower mode.

Figure 4:
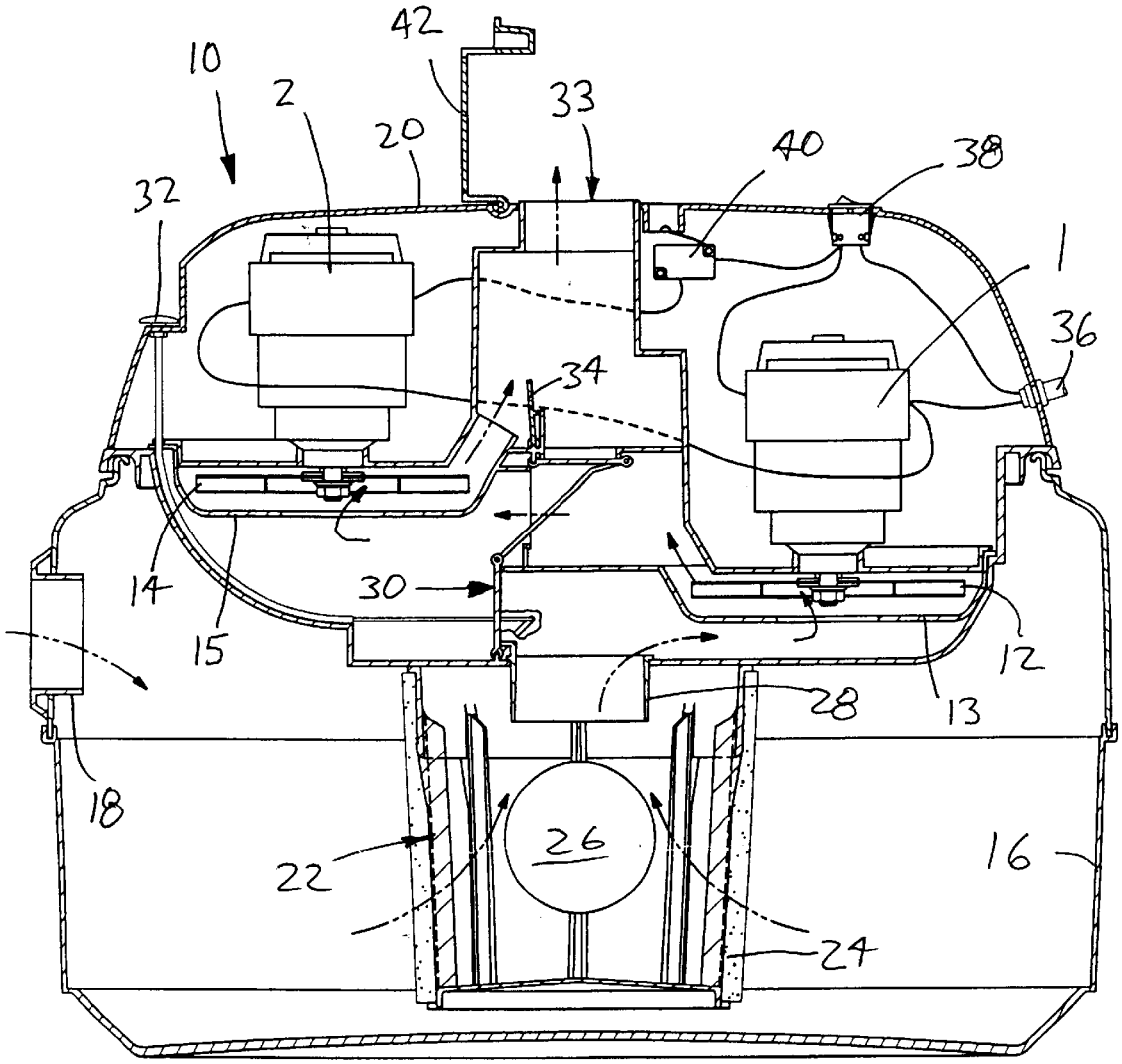
FIG. 4 is a cross-sectional view of the vacuum cleaner of FIG. 1 operating as a blower with single/series air flow.

FIG. 4 is identical to FIG. 3 except that the actuator 32 has been moved so that the air flows in series through the valve 30 such that air coming from impeller 12 is directed into impeller 14 before exiting through the outlet 33. The flapper 34 is necessarily in an open position to permit such air flow.

Numerous modifications are possible with respect to the embodiment shown in FIGS. 1–4. For instance, the switch 40 may be accompanied by other electronic circuitry to reduce current drawn in the blower mode in a different fashion. In the embodiment shown in FIGS. 1–4, a reduction in the current is accomplished by disabling motor 2. The power can be reduced in other ways, such as by using a transformer or other circuitry which would permit motor 1 and motor 2 to continue operating but at a lower current draw or power. Under such circumstances, impeller 14 and impeller 12 would both operate but at a lower number of revolutions per minute (rpm) and with a generally lower lift and CFM. Such a configuration may also be used in a vacuum cleaner that has only one motor. In such a situation, the switch 40 would reduce the current draw when the cover 42 is opened so that the outlet 33 can be used in a blower mode. In the single motor set-up, the motor would draw full power when the switch 40 is in a first condition with the cover 42 closed and would draw less power in the second condition with the cover 42 open and would thereby have a lower number of rpm's in its impeller (or impellers if the single motor has multiple impellers) resulting in less lift and CFM.

It is also possible to actuate the switch 40 in a different manner than the use of a cover as shown in FIGS. 1–4. The switch 40 can be associated with the outlet 33 in a different manner such that the switch is in a first condition when the unit is used as a vacuum cleaner and in a second condition when the unit is used as a blower. For instance, an actuator could be placed inside the outlet such that when a hose is inserted into the outlet for blower mode operation, the switch is put into the second condition, thereby permitting the vacuum cleaner 10 to draw less current than when in the vacuum mode.

Figure 5:
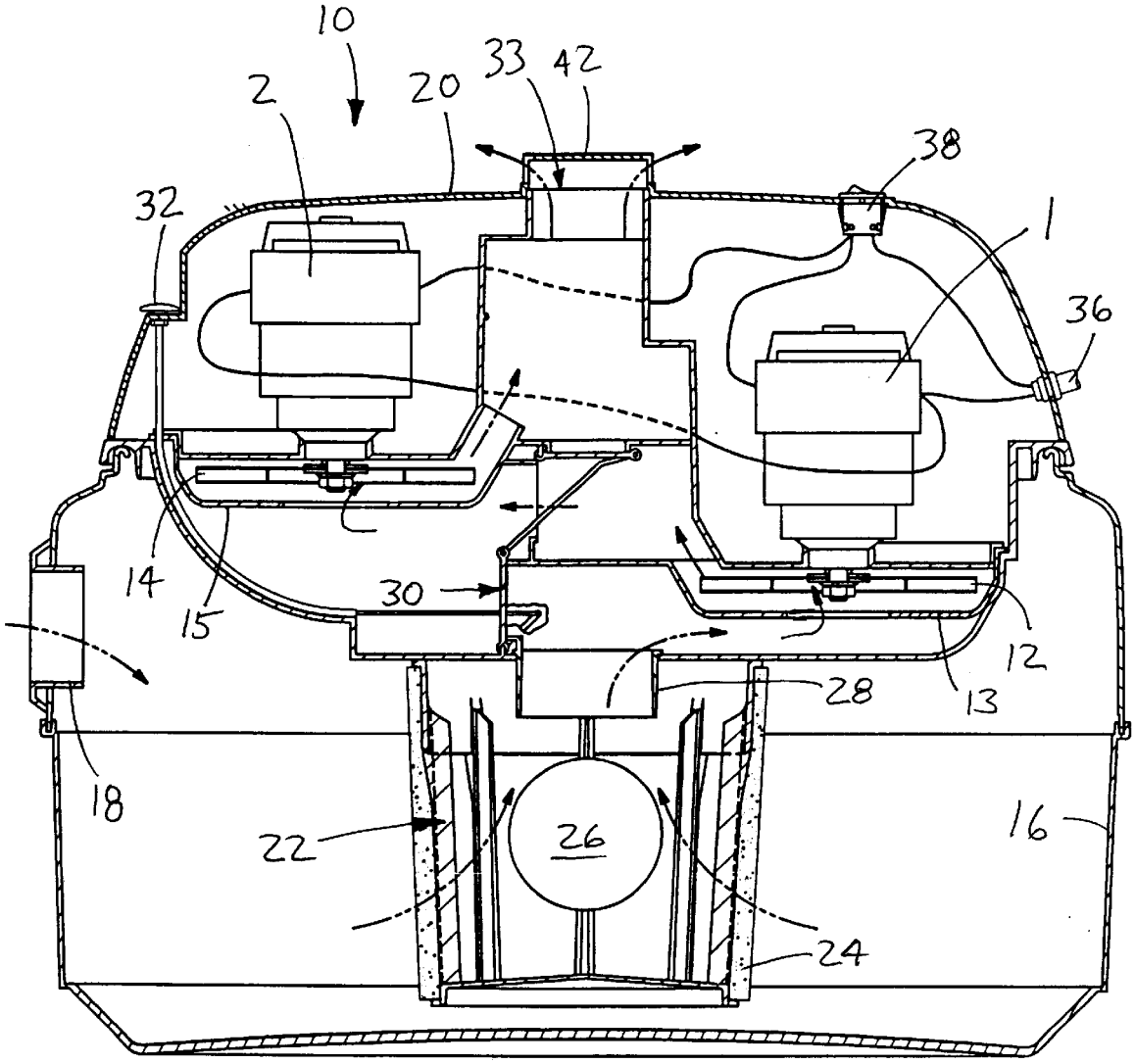
FIG. 5 is a cross-sectional view of a second embodiment of the present invention operating as a vacuum with series air flow.
Figure 6:
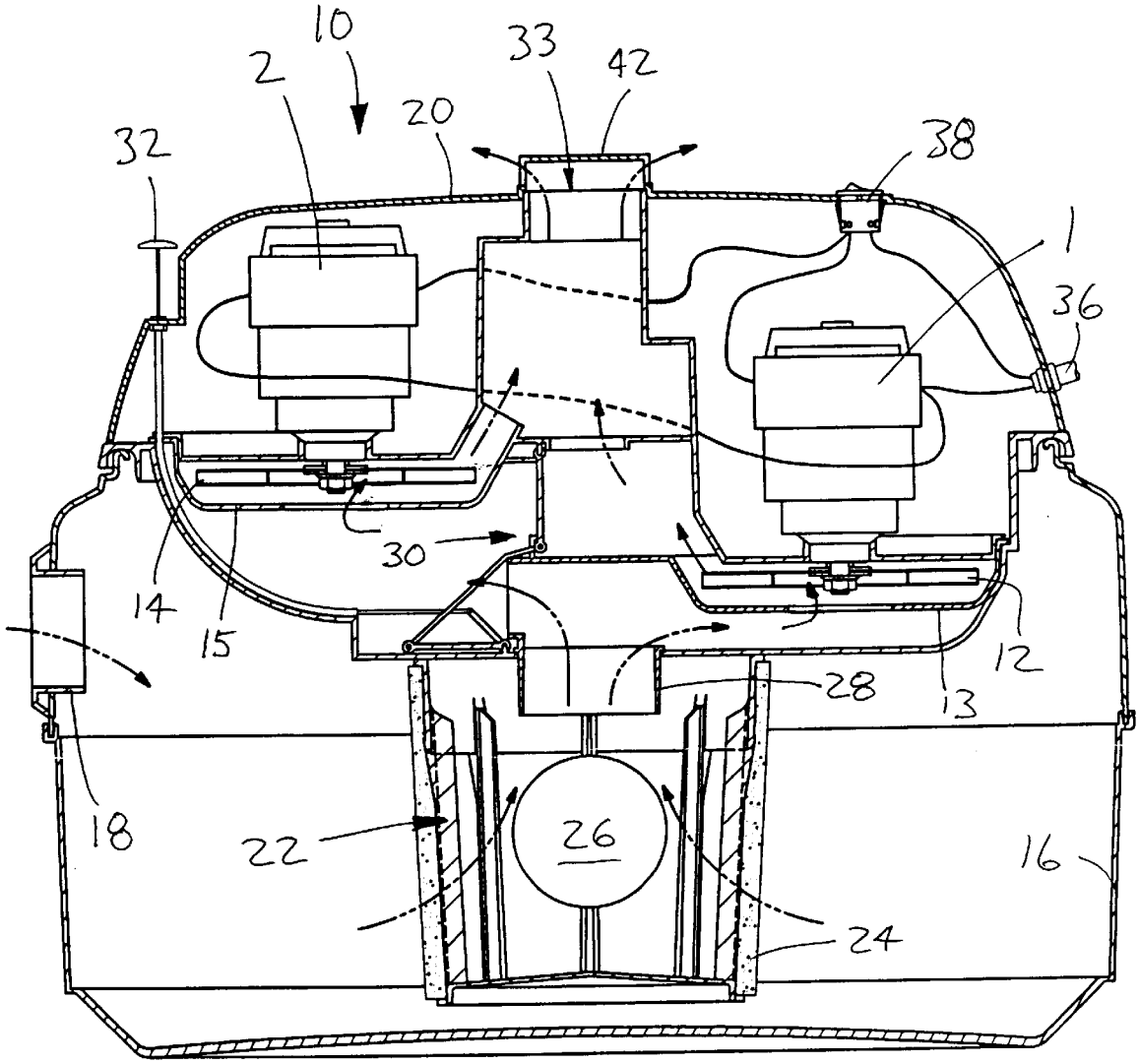
FIG. 6 is a cross-sectional view of the vacuum cleaner of FIG. 5 operating with parallel air flow.

Referring now to FIGS. 5 and 6, a second embodiment of a vacuum cleaner is shown. The vacuum cleaner of FIGS. 5 and 6 is identical to the vacuum cleaner of FIGS. 1–4, except that there is no switch 40 and there is no flapper 34. The cover over the outlet remains in place at all times so that both motors can be operated at all times assuming they are set to draw current at a level appropriate for a vacuum. The vacuum cleaner of FIGS. 5 and 6 has valving which permits conversion from series to parallel air flow.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A vacuum cleaner comprising:

at least one electric motor;

a first impeller disposed in a first impeller housing and driven by the at least one electric motor, the first impeller housing having an inlet and an outlet;

a receptacle having an inlet and an orifice in air flow communication with the first impeller housing inlet, wherein the first impeller creates a low pressure area in the receptacle thereby drawing air into the receptacle inlet;

an outlet in air flow communication with the first impeller housing outlet, wherein air from the first impeller is expelled through the outlet;

a switch, associated with the vacuum cleaner outlet, wherein the switch has a first position, in which a first current is drawn by the at least one motor and a second position in which a second current, less than the first current, is drawn by the at least one motor; and a device removably attached to the outlet for directing air, the device in a first position placing the switch in the first position for vacuum operation, and the device in a second position placing the switch in the second position for blower operation.

2. The vacuum cleaner of claim 1 wherein:

the at least one electric motor comprises two motors; and the first position of the switch permits both motors to run and the second position permits only one motor to run.

3. The vacuum cleaner of claim 1 wherein:

the at least one electric motor consists of a single motor; and the switch is operably coupled to motor current controlling circuitry so that the motor runs at a first speed with the switch in the first position and the motor runs at a slower speed with the switch in the second position.

4. The vacuum cleaner of claim 1 wherein:

the at least one electric motor comprises two motors; and the switch is operably coupled to motor current controlling circuitry so that both motors run at first speeds with the switch in the first position and both motors run at second speeds with the switch in the second position.

5. The vacuum cleaner of claims 1 wherein:

a switch actuator is associated with the vacuum cleaner outlet and the device comprises a hose, wherein the switch actuator places the switch in the first position when the hose is not attached to the outlet, and the switch actuator placing the switch in the second position when the hose is attached to the outlet.

6. The vacuum cleaner of claim 1 wherein:

the first current has a 12 amp maximum mean when measured with the inlet open and the inlet closed;

the second current has a 12 amp maximum when measured with the vacuum cleaner outlet open.

7. The vacuum cleaner of claim 1 wherein:

the device comprises a cover movably attached to the outlet; and the switch is in the first position when the cover is in a first position and the switch is in the second position when the cover is in a second position.

8. The vacuum cleaner of claim 1 wherein:

the at least one motor comprises a first motor driving the first impeller and a second motor driving a second impeller, the second impeller being disposed in a second impeller housing having an inlet in fluid communication with the orifice and an outlet in fluid communication with the vacuum cleaner outlet, a first air flow path being defined between the orifice and the first impeller housing inlet, a second air flow path being defined between the orifice and the second impeller housing inlet, a third air flow path being defined between the first impeller housing outlet and the vacuum cleaner outlet, a fourth air flow path being defined between the first impeller housing outlet and the second impeller housing inlet, and a fifth air flow path being defined between the second impeller housing outlet and the vacuum cleaner outlet; and the vacuum cleaner comprises a valve movable between a first position, in which the valve blocks the second and third air flow paths to create a series air flow from the orifice to the vacuum cleaner outlet, and a second valve position, in which the valve blocks the fourth air flow path to create a parallel air flow from the orifice to the vacuum cleaner outlet.

9. The vacuum cleaner of claim 1, in which a second impeller is driven by the at least one electric motor.

10. A vacuum comprising:

a first electric motor driving a first impeller disposed in a first impeller housing, the first impeller housing having an inlet and an outlet;

a second motor driving a second impeller disposed in a second impeller housing, the second impeller housing having an inlet and an outlet;

a receptacle having an inlet and an orifice in air flow communication with the interiors of the first and second impeller housings;

an outlet in air flow communication with interiors of the first and second impeller housings, a first air flow path being defined between the orifice and the first impeller housing inlet, a second air flow path being defined between the orifice and the second impeller housing inlet, a third air flow path being defined between the first impeller housing outlet and the vacuum cleaner outlet, a fourth air flow path being defined between the first impeller housing outlet and the second impeller housing inlet, and a fifth air flow path being defined between the second impeller housing outlet and the vacuum cleaner outlet;

a switch associated with the outlet, the switch having a first position in which a first current is drawn by the first and second motors, and a second position, in which a second current, less than the first current, is drawn by the first and second motors; and a valve movable between a first position, in which the valve blocks the second and third air flow paths to create a series air flow from the orifice to the vacuum cleaner outlet, and a second valve position, in which the valve blocks the fourth air flow path to create a parallel air flow from the orifice to the vacuum cleaner outlet.

11. The vacuum of claim 10, further comprising an actuator for moving the valve.

12. A vacuum cleaner comprising:

a first impeller disposed in a first impeller housing and driven by a first motor;

a second impeller disposed in a second impeller housing and driven by a second motor;

a receptacle having an inlet, and an orifice in fluid communication with interiors of the first and second impeller housings, wherein at least one of the first and the second impellers creates a low pressure area in the receptacle thereby drawing air through the inlet;

a housing assembly containing the first impeller housing, the second impeller housing, the first motor, and the second motor, the housing assembly having an outlet in air flow communication with the interiors of the first and second impeller housings, wherein air from the first and second housings is expelled through the outlet;

a switch associated with the housing and having a first position, in which a first current is collectively drawn by the first and second motors, and a second position, in which a second current, less than the first current, is collectively drawn by the first and second motors; and a cover associated with the outlet and movable between a first position, in which the cover obstructs the outlet, and a second position, in which the cover does not obstruct the outlet, wherein the switch is in the first position when the cover is caused to be in the first position, and the switch is caused to be in the second position when the cover is in the second position.

* * * * *